United States Patent [19]

Bisquolm et al.

[11] Patent Number: 4,513,480

[45] Date of Patent: Apr. 30, 1985

[54] CARD CLOTHING FOR CARDING FLATS

[75] Inventors: Werner Bisquolm, Siebnen; Jörg Bürki, Jona; Othmar Teuscher, Mollis, all of Switzerland

[73] Assignee: Graf & Cie AG, Rapperswil, Switzerland

[21] Appl. No.: 447,274

[22] Filed: Dec. 6, 1982

[30] Foreign Application Priority Data

Apr. 16, 1982 [CH] Switzerland ..... 2331/82

[51] Int. Cl.[3] ..... D01G 15/24

[52] U.S. Cl. ..... 19/113; 19/114

[58] Field of Search ..... 19/113, 114

[56] References Cited

U.S. PATENT DOCUMENTS

| | | | |
|---|---|---|---|
| 622,367 | 4/1899 | Hunton | 19/113 |
| 628,830 | 7/1899 | Mills et al. | 19/113 |
| 693,817 | 2/1902 | Mills et al. | 19/113 |
| 4,295,248 | 10/1981 | Beneke et al. | 19/113 |
| 4,297,768 | 11/1981 | Löffler | 19/113 |
| 4,394,789 | 7/1983 | Egerer | 19/114 X |

FOREIGN PATENT DOCUMENTS

| | | | |
|---|---|---|---|
| 5884 | of 1890 | United Kingdom | 19/113 |

*Primary Examiner*—Louis K. Rimrodt

*Attorney, Agent, or Firm*—Ladas & Parry

[57] ABSTRACT

A plurality of wire sections are lined up side by side on a carrier member. Every wire section comprises a row of teeth, a distance piece section, a web located below thereof and a foot section. A through opening is provided in the web section. The two ends of the carrier member are provided with a slot-like opening. A locking member having the form of a block is slid onto the two ends against the wire sections held in a prestressed condition. This block-like structure comprises a rectilinearly extending longitudinal bar and a further longitudinally extending bar deformed into the slot-shaped through opening. This deformed bar acts as locking element. Accordingly, the wire sections package arranged upon the carrier member is held locked in a prestressed condition. Because these wire sections are not held by means of a welding or by means of an adhesive agent on the carrier member, savings regarding costs and materials are achieved.

3 Claims, 6 Drawing Figures

CARD CLOTHING FOR CARDING FLATS

BACKGROUND OF THE INVENTION

1. Field of the Invention

The present invention relates to an improved card clothing for the flats of a carding machine, which card clothing comprises a plurality of mutually abutting wire sections arranged side by side and having a row of teeth and a foot section each.

The main operating elements of a carding machine are its drum rotating at a relatively high speed and the carding flats which move along a section of the circumference of this drum. The flats including the card clothing are moved thereby in a direction which corresponds to the direction of rotation of the drum whereby however the speed of the flats is vastly smaller than the circumferential speed of the drum. A metal wire which is provided with teeth or shaped, respectively, to have teeth extending along one edge thereof is wound around the drum. The flats are provided either with hook-like members inserted through a carrier or are provided with a plurality of wire sections comprising teeth of a construction and design similar to the construction and design of the wire which is wound around the drum. The fibers fed into the carding machine are acted upon by the teeth extending around the drum and the teeth of the card clothing of the flats and will accordingly be loosened, mechanically cleaned and oriented to extend roughly parallel to each other and accordingly shaped to a web or sliver, respectively, which finally is condensed into a card sliver.

2. Description of the Prior Art

The DE-OS No. 2 145 459 discloses a card clothing for flats of a carding machine, in which the connection between the wire sections and their carrier member, which in turn is mounted onto the flat, are weldings or formed by adhesive agents. Such welding or gluing, respectively, is, however, rather time-consuming and accordingly the production costs stemming thereof are rather high.

SUMMARY OF THE INVENTION

Hence, it is a general object of the present invention to provide an improved card clothing for the flats of a carding machine which is extremely simple in construction and design, reliable in operation, economical to manufacture and dependable in use.

Now, in order to implement these and still further objects of the invention, which will become more readily apparent as the description proceeds, the improved card clothing for the flats of a carding machine of this development is manifested by the features of comprising an elongated carrier member on which the wire sections are lined up side by side in a mutually prestressed condition, which said carrier member is provided with locking members which clampingly hold said wire sections permanently at a prestressed condition locked on said carrier member.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENT

Figures 1, 2, 3:
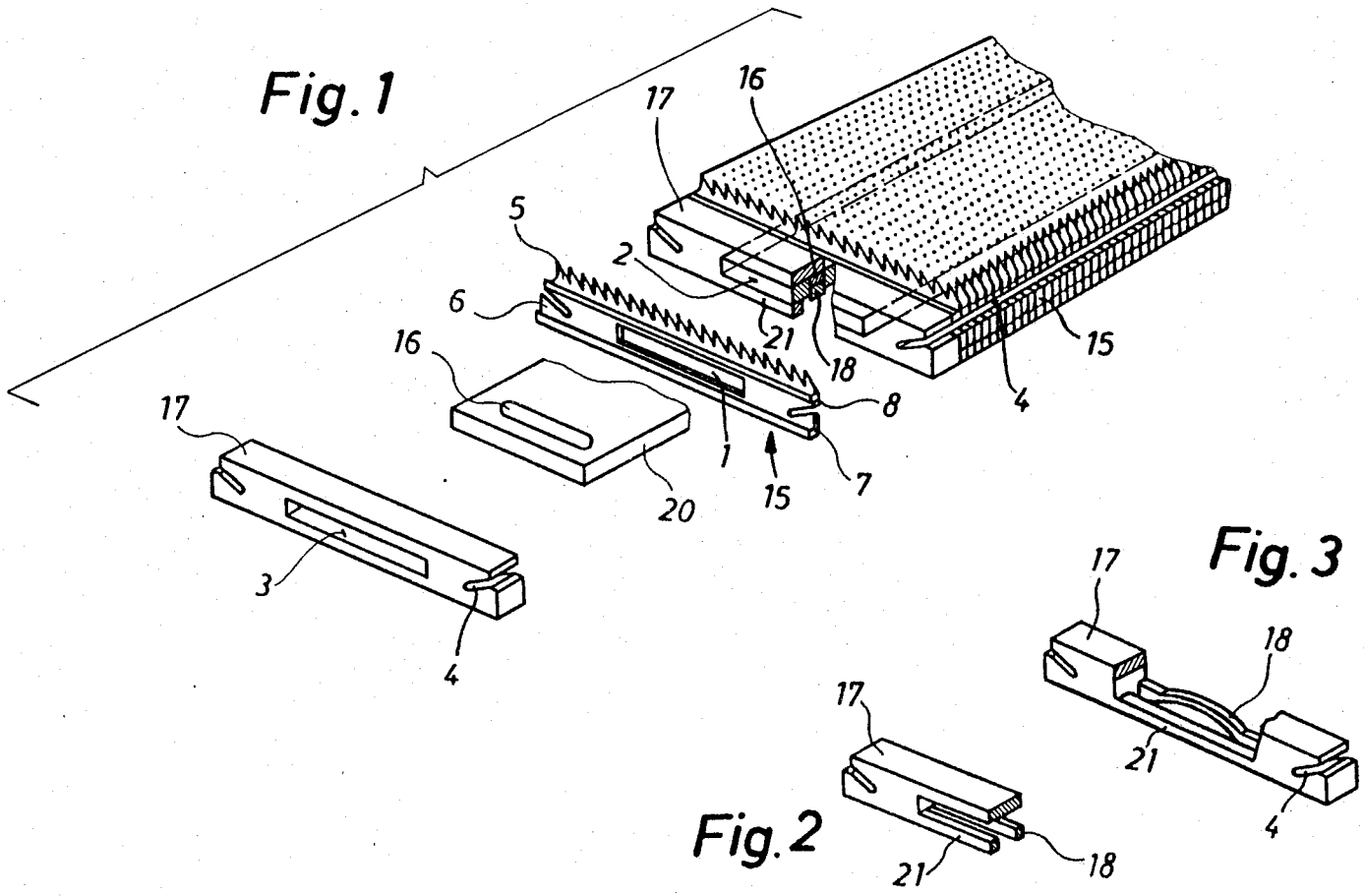
FIG. 1 is an exploded view, shown partly in section, of a first preferred embodiment of the invention.
FIG. 2 is a view of a locking member cut about along its center line.
FIG. 3 is a view of the locking member of FIG. 2 shown in its locking condition having a plastically deformed locking element.

Reference numeral 15 of FIG. 1 identifies a wire section of a so-called all-steel card clothing or metal card clothing, respectively. As commonly known, every flat of a carding machine is provided with a plurality of such wire sections. The wire section 15 shown in this figure is specifically a so-called profile having a double foot. The wire section 15 is provided with one row of teeth 5. This row of teeth 5 extends along a distance piece section 8. Immediately below this distance piece section 8 there extends a web section 6 terminating at its lower end at a heel or foot, respectively, section 7. Both ends or face areas, respectively, of the web section 6 are provided with a recess 4 extending somewhat slanted, which recess 4 is intended to receive a leg 9 of the clamp 11 mounting the card clothing to the flat 10 (see also FIG. 4).

A rectangular through opening 1 extends through the web section 6 of the wire section 15. A plurality of wire sections 15 is lined up on a carrier member 20, which carrier member 20 extends through every respective through opening 1 of every individual wire section 15. The preferred embodiment of the carrier member 20 shown in FIG. 1 is a profile having a rectangular cross section, whereby obviously the cross-sectional shape of through opening 1 corresponds to the cross-sectional shape of such profile. It must, however, be noted that such carrier member 20 may be given a large variety of cross-sectional shapes, for instance such carrier member may be designed having an oval cross-sectional shape, a cross section having rounded edge areas, it may be a U-profile or a double-T profile, etc. A slot-like through opening 16 is located at the end section of mentioned carrier member 20. Adjacent the outermost wire section 15 of the package of wire sections lined upon the carrier member 20 a locking member 17 having the shape of a block is slid upon the carrier member 20. The block-like structure is also provided with slanted recesses 4 and a through opening 3 similar to the corresponding design of the wire sections 15 described above.

As shown clearly in FIG. 2 the section of the block 17 which defines the through opening 3 at its lower limit is separated into two longitudinally extending bars 18 and 21, which extend parallel to each other and in the longitudinal direction of block 17. During assembly this block 17 is slid upon the carrier member 20 as last member (in relation to the wire sections 15) in the condition shown in FIG. 2. In order to achieve the locking the bar 18 located immediately adjacent the last wire section 15 is plastically deformed upwards such that a section thereof extends curvilinearly (see FIG. 3) such that this deformed bar 18 engages into the slot-like opening 16 located at the end of the carrier member 20. This locking position of lock 17 at the end of the carrier member 20 including the wire sections 15 slid upon carrier member 20 is shown in FIG. 1 where attention is drawn to reference numeral 18 leading to the deformed section of the locking bar.

It must be mentioned hereby that the individual wire sections 15 are prestressed against each other in longitudinal direction of the carrier member 20 such that they abut each other under a mutually prestressed condition and that block 17 is mounted onto the carrier member 20 at the prestressed condition of wire sections 15 and locked at a maintaining of this prestressed condition such that the complete package of wire sections 15 remains at a prestressed condition.

The carrier member 20 of this preferred embodiment comprises at both its ends a slot-like opening 16 and a block-like structure 17, each acting as locking member. According to a further embodiment, however, one end of this elongated carrier member carries an integrally therewith shaped end block, i.e. such carrier member comprises, for instance, a T-shaped end, in which case then merely the opposite end of the carrier member 20 would have to be provided with a locking block 17.

Figure 4:
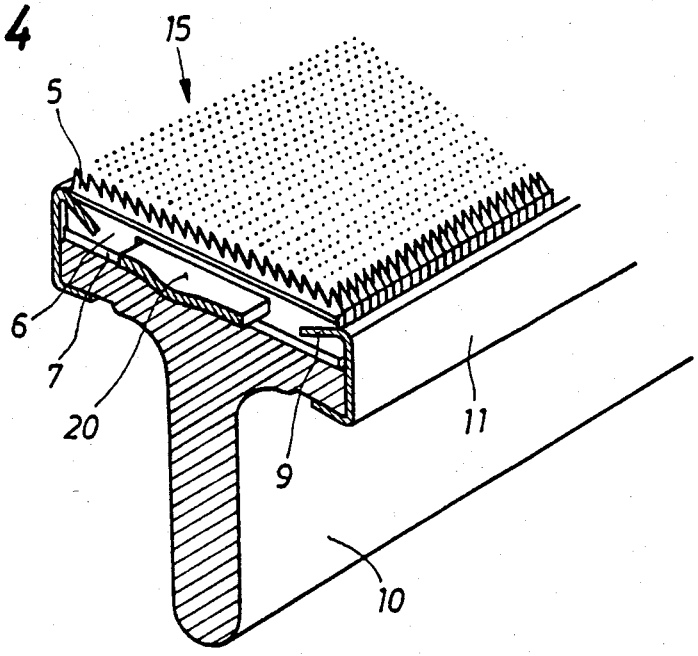
FIG. 4 is a view of the card clothing of FIG. 1 mounted to a flat.

FIG. 4 discloses a perspective view shown in section of the wire sections 15 lined upon the carrier 20, i.e. FIG. 4 discloses the complete card clothing which is mounted to the flat 10 of the carding machine. The structural element of this mounting is a clamp 11, which engages by means of a leg 9 into the slanted slots 4 of the wire sections 15 as well as of block 17. Accordingly, it can be clearly seen that neither a line of welds nor a bonding agent as is common in the prior art is necessary for securing this inventive card clothing to its flat 10.

It is, furthermore, to be distinctly noted that quite obviously a variety of techniques are possible for locking the wire sections in a mutually prestressed condition to the carrier member 20 and that the embodiment shown is the preferred embodiment. Other possibilities which may come to mind of a person skilled in the art would be, for instance, an application of screw bolts, of riveting, etc.

Figure 5:
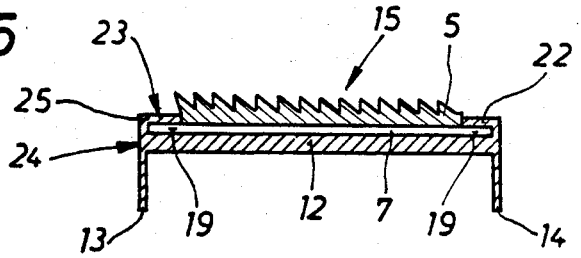
FIG. 5 is a view of a section through a second preferred embodiment and FIG. 6 is a perspective view of the embodiment shown in FIG. 5.
Figure 6:
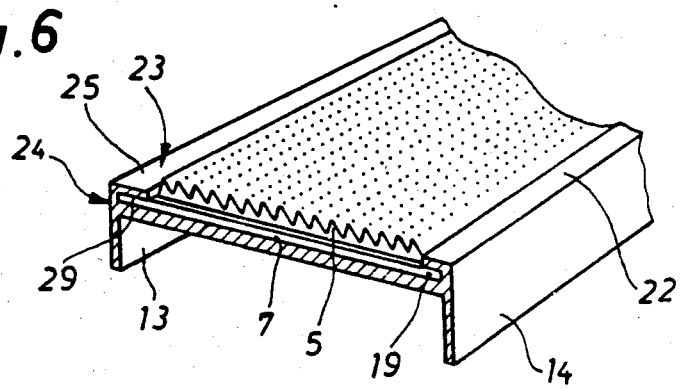

A further embodiment is shown in FIGS. 5 and 6. The wire sections 15 of this particular embodiment are no double foot-wires, they rather are a design comprising a row of teeth 5 and a foot or heel, respectively, section 7. Noteworthy is that the row of teeth 5 does not extend to the outermost ends or limits, respectively, of the wire such that a smooth foot section 19 each is located at the two ends of the wire whereby the row of teeth 5 extends between these two smooth end sections 19.

The carrier 24 of this embodiment is a profile having a web section 12. From both longitudinal edges of this web section 12 a leg section 13, 14 projects downwardly, which leg sections 13, 14 extend perpendicularly to web section 12. The web section 12 is provided at the side oppositely of the side at which the legs 13, 14 are located at both longitudinal edges with guide and clamping strips 22, 25 which extend from mentioned edge against the center of web 12. During assembly of this card clothing the individual wire sections 15 are slid upon the carrier 24 such that the smooth end sections 19 are located in the space defined by web section 12 and the two strips 22 and 25 and thereafter prestressed against each other seen in longitudinal direction of carrier 24. In order to lock this complete assembly the end sections 23 of the strips 22 and 25 are clamped against the smooth foot sections 19 of the two outermost wire sections 15 such that again the wire sections 15 are held in a prestressed condition upon the carrier 24.

According to a further embodiment it is obviously also possible to clamp the strips 22, 25 along their complete longitudinal extent against the smooth foot sections 19 of all wire sections 15.

In order to mount the card clothing onto flat 10 (see FIG. 4) use is made of mentioned longitudinally extending legs 13, 14 which act in place of the clamp 11 of the previously described embodiment. These longitudinally extending legs 13, 14 will be clamped in accordance with above mentioned embodiment under the corresponding section of the flat 10 such that against an extremely simple mounting of the card clothing to the flat is achieved without having to use welding procedures or bonding agents.

Again it is important to note that the clamping of the two outermost wire sections 15 onto the carrier member 24 is an example only and that any other mounting and locking procedure can be applied in accordance with the knowledge of a person skilled in the art.

While there are shown and described present preferred embodiments of the invention, it is to be distinctly understood that the invention is not limited thereto, but may be otherwise variously embodied and practiced within the scope of the following claims.

Accordingly, What is claimed is:

1. An improved card clothing for the flats of a carding machine, which card clothing comprises a plurality of mutually abutting wire sections arranged side by side and having a row of teeth and a foot section each, the improvement comprising an elongated carrier member on which said wire sections are lined up side by side in a mutually prestressed condition, which said carrier member is provided with locking members which clampingly hold said wire sections permanently at a prestressed condition locked on said carrier member, said every wire section further comprises a web section which extends between said row of teeth and said foot section and comprises further a distance piece section projecting from said web at a location intermediate said row of teeth and said foot section, further wherein said carrier member is an elongated profile and a through opening is provided in the web of every said wire section, and wherein said carrier member is provided at least at one end with a through opening intended for receiving a locking element of said locking member for said web sections, said through opening located at one end of said carrier member is an elongated opening which extends parallel to its face surface, said locking element is a block-like structure slid onto said carrier member and provided with a through opening, said through opening having dimensions corresponding to the dimensions of the through opening located in said web of said wire sections, further wherein the height of said block-like structure equals the height of said web inclusive said foot and said distance piece section of said wire sections such that said block-like structure contacts the outermost wire section at said foot and at said distance piece section, and wherein said locking element is a plastically deformable section of said block-like structure.

2. The improved card clothing of claim 1, wherein the section of said block-like structure which contacts said foot of said web of said outermost wire section and closes off said through opening of said block-like structure at its lower end is separated into two longitudinally thereof extending bars, of which bars the one located immediately adjacent said outermost wire section is plastically deformed such that it projects into said through opening located at the end of said carrier member and defines said locking element, and wherein the outer surface of the other of said two bars is aligned with said face surface of said carrier member.

3. The improved card clothing of claim 2, wherein both face areas of every wire section and both face areas of said block-like structure are provided with a recess which extends slanted relative to the longitudinal extent of every said wire section and said block-like structure, respectively, which slanted recess is intended to receive a leg of the clamp, by means of which the card clothing is mounted on its flat.

* * * * *